United States Patent [19]

LaKier

[11] Patent Number: 4,949,864

[45] Date of Patent: Aug. 21, 1990

[54] PAINT BRUSH HOLDER

[76] Inventor: Earl I. LaKier, 9 Brisbane Dr., Charleston, S.C. 29407

[21] Appl. No.: 400,589

[22] Filed: Aug. 30, 1989

[51] Int. Cl.[5] ..... B65D 55/00

[52] U.S. Cl. ..... 220/90; 15/257.05; 401/121; 206/361

[58] Field of Search ..... 220/90; 206/361; 15/275.05, 260, 263; 401/201

[56] References Cited

U.S. PATENT DOCUMENTS

| | | | |
|---|---|---|---|
| 593,480 | 11/1897 | Lewis | 15/257.05 |
| 1,851,521 | 3/1932 | Olsen | 206/361 |
| 2,723,410 | 11/1955 | Sprung et al. | 401/121 X |
| 3,948,413 | 4/1976 | Gorrell et al. | 220/90 |
| 4,014,453 | 3/1977 | Tarnacki | 220/90 |
| 4,266,746 | 5/1981 | Klaiber | 220/90 X |
| 4,275,818 | 6/1981 | Church | 15/257.05 X |
| 4,771,501 | 9/1988 | Leiter | 220/90 X |
| 4,854,470 | 8/1989 | Ireland | 220/90 |

*Primary Examiner*—Stephen P. Garbe
*Assistant Examiner*—Christine A. Peterson
*Attorney, Agent, or Firm*—B. Craig Killough

[57] ABSTRACT

A paint brush holder which allows a paint brush to be incremental lowered into a paint can as paint is removed from the brush from the can by means of the brush. The holder as characterized by a plate which rests in a pivotal fashion on the edge of the paint can, with one end of said plate lowered into the paint can by means of a tie attached to the paint can opposite said plate.

8 Claims, 1 Drawing Sheet

PAINT BRUSH HOLDER

BACKGROUND OF THE INVENTION

The present invention relates to painting generally, and is specifically directed to a paint brush holder which may be attached to a standard paint can and used to progressively lower a paint brush into a can of paint as paint is extracted from the can.

Paint is typically packaged in cans. For most household uses, paint is packaged in cans which are most commonly gallon sizes, although paint is packaged in cans and containers of various sizes.

Paint is commonly applied by means of a paint brush. The paint brush is dipped into a paint can so that paint is received by the bristles of the brush, and the paint is then applied by means of the brush.

Paint cans do not provide a means for the paint brush to rest upon when it is not in use, other than laying the paint brush over the top of the paint can, which is messy and allows the bristles to dry out while not in use.

SUMMARY OF THE PRESENT INVENTION

The present invention provides a paint brush holder which may be attached to paint cans of the type which are commercially prevalent, without modification, and may be used with paint brushes of various widths of the type which are uniformly and commonly in use. The device may be used with paint cans of various sizes as well.

The present invention is attached to the lip or rim of a paint can. One side of the holder is in a pivotal relationship with the can, and is connected to the opposite side of the holder by means of a tie or other connecting arrangement whose length may be variably and selectively adjusted. The tie is used to allow the side of the holder which is in a pivotal relationship with the paint can to lower the paint brush into the paint can as the level of paint within the can is reduced.

The plate which supports the paint brush provides holes which allow easy submersion for the withdrawal and draining of residual paint from the device.

The device may provide a means which allows excess paint to be wiped from the bristles of the brush in a manner which is superior to the use of the rim of the paint can.

The device allows the bristles of the brush to be immersed in paint when the paint brush is not in use, so that the bristles do not dry out when painting is interrupted for an extended period.

The device will also serve as a guide in wetting the bristles to a predetermined depth so that the desired amount of paint is consistently applied.

DETAILED DESCRIPTION OF THE DRAWINGS

DETAILED DESCRIPTION OF THE PREFERRED EMBODIMENT

Figure 2:
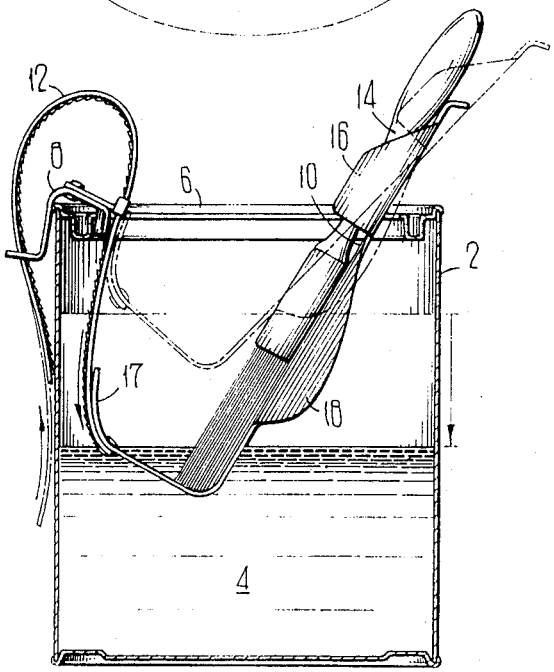
FIG. 2 is a side elevation showing the paint can as sectioned as to reveal the level of paint within the paint can, and the device as it rests upon and is lowered into the paint can.

Referring to the drawings, the preferred embodiment shows the invention attached to a conventional paint can 2. The paint can 2 is in essence a cylinder having a closed bottom and a top opening. Paint 4 is present within the paint can as shown in FIG. 2, with the level of paint reduced progressively as it is removed from the paint can by the paint brush as shown by the vertical arrow of FIG. 2 showing the drop in the paint level.

The device is attached to the rim or lip 6 of the opening of the paint can 2. A clip 8 is attached to the rim of the paint can, and a plate 10 rests on the rim 6 of the paint can opposite the clip 8. The clip 8 is connected to the plate 10 by means of a tie 12 which may be lengthened or shortened so as to change the relationship of the plate 10 to the paint can 2 as will be seen.

The clip 8 is a flexible material which can be made from a resilient material, such as plastic. It is snapped on to the rim, and its elastic characteristics and shape conform to the rim configuration, holding it in place.

The plate 10 is designed so as to allow a paint brush 14 to rest thereon when the paint brush 14 is not in use. The plate 10 is generally a flat plane, which in the preferred embodiment may grow progressively wider near the bottom thereof, and which has a lip extending 90° therefrom. Tabs 16 may be provided to aid in keeping the paint brush within the plate. Holes 20 are provided in the bottom of the plate to allow paint to enter and drain from the plate as it is raised and lowered. (NOTE: show holes in drawings)

The plate 10 is not attached to the paint can, but rather rests on the lip or rim 6 of the paint can opposite the clip 8. The clip 8 is connected to the plate by means of a tie 12 as shown is FIGS. 1 and 2. Since the plate 10 is not attached to the paint can, but rather rests on the rim of the paint can, it is in a pivotal relationship with the paint can by means of its connection to the clip and tie, but slides along the rim of the paint can. As shown if FIG. 2, as the tie is extended, the lower edge of the plate is caused to be extended deeper into the paint can. The plate may be lowered as necessary by means of the tie to place the plate and paint brush into a consistent depth of paint. Likewise, the tie may be restricted and pulled back through the clip so as to raise the lower edge of the plate.

The tie may be most any means which will control the lower edge of the plate so as to allow the plate to be selectively positioned as desired. In the preferred embodiment, and as shown, the tie is a rachet type tie which will allow the plate to be positioned according to any notch on the rachet type tie.

Figure 1:
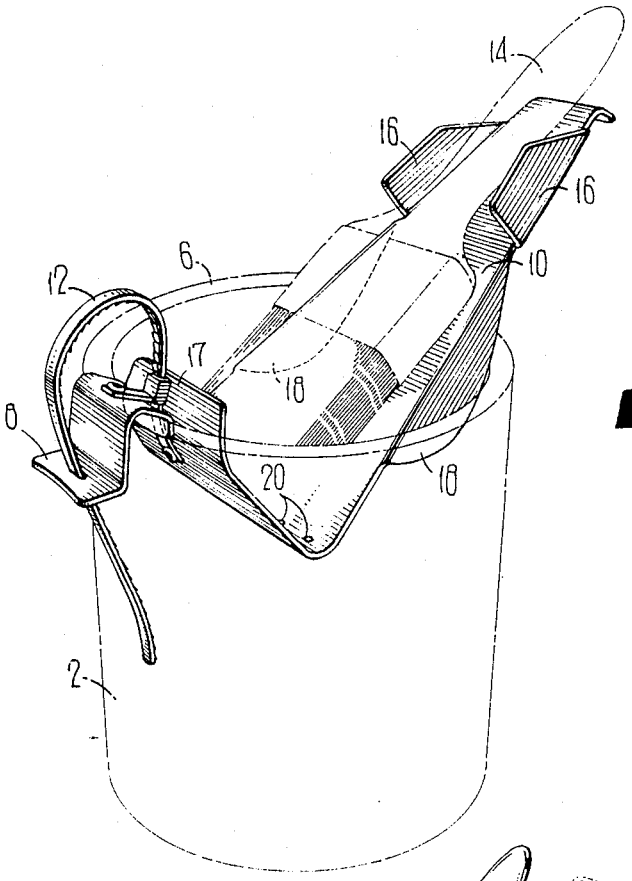
FIG. 1 is a perspective view of the device as attached to a paint can which is shown as a phantom, with a paint brush, also shown as a phantom, resting thereon.

To use the device, the clip is attached to one edge of the paint can, and the plate is allowed to rest on the opposite side of the rim of the paint can. Assuming that the paint can is full, the tie will be pulled through the clip so as to raise the plate as shown in FIG. 1. The paint brush is dipped into the paint can, with the level of the paint extending above the lowest portion of the plate as desired. As paint is used, the tie is selectively pushed through the clip so as to cause the lower edge of the plate to be submersed in paint. FIG. 2 shows the travel of the tie through the clip as it is lowered into the paint.

Lip 17 provides a surface which can be used to remove excess paint from the brush. The paint brush may be wiped across lip 17 to remove excess paint, which will drain through holes 20.

The cam shaped surface 18 of plate 10 controls the angle of the plate 10 and the brush 14 resting therein as the plate is lowered into the paint can 2. The use of curved surface 18 allows the paint brush 14 to be held in a relatively vertical alignment as the plate is lowered by means of the tie 12.

What is claimed is:

1. A brush holder, comprising:

a. a clip which is attached to a rim of an opening of a container;

b. a plate which rests on said rim of said container; and c. a connecting means, one end of which is attached in a fixed manner to said plate, and which connects said clip and said plate, wherein the effective length of said connecting means may be increased or decreased so as to lower or raise said plate within said container.

2. A brush holder as described in claim 1, wherein the length of said connecting means is decreased by pulling said connecting means through said clip, and is increased by pushing said connecting means through said clip, so as to control the distance between said clip and said plate.

3. A brush holder as described in claim 1, wherein said plate further comprises a lip located near a point where said connecting means is attached to said plate, and wherein said lip is formed up and away from said plate so as to allow a surface against which a brush may be wiped so as to remove excess material from said brush.

4. A brush holder as described in claim 2, wherein said plate further comprises a lip located near a point where said connecting means is attached to said plate, and wherein said lip is formed up and away from said plate so as to allow a surface against which a brush may be wiped so as to remove excess material from said brush.

5. A brush holder as described in claim 1, wherein a surface of said plate which rests on said container is curved along the length thereof so as to keep an angle of the brush resting on said plate constant in relation to said container as the distance between said plate and said clip is increased or decreased, and said brush is lowered into said container or raised within said container.

6. A brush holder as described in claim 2, wherein a surface of said plate which rests on said container is curved along the length thereof so as to keep an angle of the brush resting on said plate constant in relation to said container as the distance between said plate and said clip is increased or decreased, and said brush is lowered into said container or raised within said container.

7. A brush holder as described in claim 3, wherein a surface of said plate which rests on said container is curved along the length thereof so as to keep an angle of the brush resting on said plate constant in relation to said container as the distance between said plate and said clip is increased or decreased, and said brush is lowered into said container or raised within said container.

8. A brush holder as described in claim 4, wherein a surface of said plate which rests on said container is curved along the length thereof so as to keep an angle of the brush resting on said plate constant in relation to said container as the distance between said plate and said clip is increased or decreased, and said brush is lowered into said container or raised within said container.

* * * * *